US009227766B2

(12) United States Patent
Ziegenfelder

(10) Patent No.: US 9,227,766 B2
(45) Date of Patent: Jan. 5, 2016

(54) POURING SPOUT FOR CONTAINER

(71) Applicant: Sonoco Development, Inc., Hartsville, SC (US)

(72) Inventor: Kurt Ziegenfelder, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 104 days.

(21) Appl. No.: 14/182,868

(22) Filed: Feb. 18, 2014

(65) Prior Publication Data

US 2015/0232239 A1 Aug. 20, 2015

(51) Int. Cl.

| | |
|---|---|
| ***B65D 47/06*** | (2006.01) |
| ***B65D 25/28*** | (2006.01) |
| ***B65D 25/44*** | (2006.01) |
| *B65D 51/18* | (2006.01) |

(52) U.S. Cl.

CPC ..... *B65D 25/2897* (2013.01); *B65D 25/44* (2013.01); *B65D 47/061* (2013.01); *B65D 51/18* (2013.01); *B65D 2251/0018* (2013.01); *B65D 2251/0093* (2013.01)

(58) Field of Classification Search

CPC ..... B65D 47/06; B65D 47/26
USPC ..... 222/531, 526, 522, 567, 569, 570
See application file for complete search history.

(56) References Cited

U.S. PATENT DOCUMENTS

| | | | | |
|---|---|---|---|---|
| 70,613 | A | | 11/1867 | Putnam |
| 416,435 | A | | 12/1889 | Benner |
| 430,820 | A | | 6/1890 | Banker |
| 445,067 | A | | 1/1891 | Lyon |
| 464,276 | A | | 12/1891 | Delane |
| 575,610 | A | | 1/1897 | Malcolm |
| 577,767 | A | | 2/1897 | Lyon |
| 621,686 | A | | 3/1899 | Lyon |
| 637,514 | A | | 11/1899 | Leek |
| 706,710 | A | | 8/1902 | Allen |
| 716,257 | A | | 12/1902 | Lunt |
| 843,895 | A | * | 2/1907 | Koch ..... 126/283 |
| 914,766 | A | | 3/1909 | Rensselaer |
| 1,145,896 | A | | 7/1915 | Hothersall |
| 1,276,382 | A | | 8/1918 | Loveland |
| 1,326,053 | A | | 12/1919 | Henry |
| 1,377,801 | A | | 5/1921 | Brown |
| 1,859,126 | A | | 5/1932 | Boeuf |
| 1,885,533 | A | | 11/1932 | Molitor |
| 1,914,765 | A | | 6/1933 | Zahn et al. |
| 2,059,608 | A | | 11/1936 | Rochester |
| 2,083,135 | A | | 6/1937 | Agerell et al. |
| 2,087,929 | A | | 7/1937 | Stargardt |
| 2,120,566 | A | | 6/1938 | Matter |
| 2,312,180 | A | | 2/1943 | Manly |
| 2,352,587 | A | * | 6/1944 | Muller ..... 222/531 |
| 2,379,327 | A | | 6/1945 | Waite |
| 2,379,853 | A | | 7/1945 | Smith |
| 2,424,101 | A | | 7/1947 | Lari |
| 2,519,539 | A | | 8/1950 | Bonkowski |

(Continued)

*Primary Examiner* — Donnell Long
(74) *Attorney, Agent, or Firm* — Flaster/Greenberg, P.C.

(57) ABSTRACT

A pouring spout is mounted within an opening in a container. The spout includes an open channel or trough dimensioned for slidable engagement within the opening. The open channel is defined by a u-shaped wall extending between a mounting end and a discharge end. An end wall is formed at the discharge end, adjacent a discharge opening formed in the bottom surface of the u-shaped wall. A visible flow path is formed along the open channel, between the inlet to the discharge opening.

16 Claims, 10 Drawing Sheets

(56) References Cited

U.S. PATENT DOCUMENTS

| | | | | | |
|---|---|---|---|---|---|
| 2,574,989 | A | | 11/1951 | Waite | |
| 2,574,990 | A | | 11/1951 | Waite | |
| 2,601,941 | A | | 7/1952 | Phillips, Jr. | |
| 2,772,037 | A | | 11/1956 | Rieke | |
| 2,790,582 | A | | 4/1957 | Halpern | |
| 2,919,057 | A | | 12/1959 | Halpern | |
| 3,146,921 | A | | 9/1964 | Brady | |
| 3,151,779 | A | * | 10/1964 | Rensch et al. | 222/570 |
| 3,164,302 | A | | 1/1965 | Indjian | |
| 3,172,573 | A | | 3/1965 | Parish, Jr. et al. | |
| 3,207,388 | A | | 9/1965 | Waddington et al. | |
| 3,217,945 | A | | 11/1965 | Monaco | |
| 3,315,848 | A | | 4/1967 | Anfossi | |
| 3,347,425 | A | | 10/1967 | Beushausen et al. | |
| 3,889,854 | A | | 6/1975 | Gagnon et al. | |
| 4,111,340 | A | * | 9/1978 | Greenhow et al. | 222/527 |
| 4,408,703 | A | | 10/1983 | Libit | |
| 4,591,074 | A | | 5/1986 | Kennings | |
| 4,836,424 | A | | 6/1989 | Afshar | |
| 6,364,178 | B1 | | 4/2002 | Paczonay | |
| 6,601,740 | B1 | | 8/2003 | Clive | |
| 7,980,426 | B2 | | 7/2011 | Vollmann et al. | |

* cited by examiner

POURING SPOUT FOR CONTAINER

FIELD OF THE INVENTION

The present disclosure relates to a spout that serves for pouring a flowable product, such as a liquid, granular or powdered material, from a container.

BACKGROUND

A number of forms of spouts are known for dispensing a flowable product from containers. For example, Anfossi U.S. Pat. No. 3,315,848 shows a dispensing cap that fits within the opening of a bottle. The cap includes an elongated tubular body and is moveable from a first position where the cap seals the bottle opening. A secondary discharge position is created when the cap is pulled partially out from the bottle opening. A flow channel is formed between an inlet on the side wall of the tube at the rear end of the cap and an outlet formed in the side of the tube at the projected end of the cap. The inlet and outlet are formed on opposite sides of a centerline of the tubular cap. A third position is also defined where the cap is extended to engage a stop on the rear end of the cap body with the inside wall of the bottle opening. In the third position the flow channel is closed.

Rochester U.S. Pat. No. 2,059,608 shows a dispensing can having a moveable carrier provided within a channel in the can. The carrier is normally positioned within the can and includes a central compartment that is open at the top to receive product. The compartment holds a single discharge dose. Movement of the carrier within the channel extends the carrier to a position outside of the can. When the compartment is extended outside of the channel, product is discharged through a bottom opening. The compartment is slid back inside the can for receiving a product refill.

Agerell et al U.S. Pat. No. 2,083,135 shows a slidable tray or trough member retained in a channel formed within the body of a container. In the retracted position, the tray is open to receive a measured product dose. Extending the tray from the channel exposes the product within the tray, while sealing the container opening by means of a rear wall on the tray.

Rieke U.S. Pat. No. 2,772,037 shows a container closure that extends to form a pouring spout. The closure fits within a fitment mounted in an opening within the container wall. The closure includes an end wall having a gripping flange thereon, an elongated tubular body and an open rear end. A circular discharge opening is provided in the wall of the body and is positioned adjacent the end wall. In the retracted position, the end wall seals the fitment and the container. In the extended position, a flow channel is formed from the rear opening, through the hollow body, to discharge opening. The circular wall of the body member is closed except for the discharge opening.

Banker U.S. Pat. No. 430,820 shows a spout structure similar in function to that in Rieke. A valve member is positioned at the end of the tapered hollow body for opening and closing the discharge opening.

SUMMARY OF THE INVENTION

In one aspect of the disclosure, a pouring spout is provided for mounting within an opening in a container. The pouring spout includes a trough dimensioned for slidable engagement within a container opening. The trough includes a mounting end, a discharge end and a substantially u-shaped wall extending between the mounting and discharge ends. The u-shaped wall forms a channel having an open upper area extending along at least a portion of the trough adjacent the discharge end. An end wall is formed at the discharge end of the trough, which extends across and closes the channel formed by the u-shaped wall. A discharge opening is formed in the u-shaped wall adjacent the end wall at the discharge end. An inlet opening is provided within the mounting end of the trough. The inlet opening communicates with the open channel and a flow path is formed between the inlet opening, the open channel and discharge opening. Further, a closure lip is formed on the mounting end of the trough for embracing an inside edge of the container opening and for removably mounting the trough in a projected position with respect to the container. The function of the spout is to permit pouring of the container contents along the flow path formed by the trough, while being visible along the open top of the u-shaped trough. The discharge flow of the contents from the container is visible from the open top of the through and is discharged in an opposing direction from the open top end of the spout.

In a further aspect of the disclosure, a container and pouring spout combination is provided. The container retains a quantity of a pourable material within an interior chamber, the chamber defined by one or more side walls, a bottom wall and top wall. An opening is formed in one of the walls, with the opening having a defined edge and providing access to material stored within the chamber. The pouring spout includes a trough dimensioned for slidable engagement within the container opening. The trough includes a mounting end, a discharge end and a substantially u-shaped wall extending between the mounting and discharge ends. The u-shaped wall forms a channel that is open at least a portion of the trough adjacent the discharge end. An end wall is formed at the discharge end of the trough and extends across and closing the channel formed by the u-shaped wall. A discharge opening is formed in the u-shaped wall adjacent the end wall at the discharge end and opposite of the open portion of the channel. An inlet opening is provide at the mounting end of the trough, with the inlet opening communicating with the open channel formed by the u-shaped wall. A flow path is formed between the inlet opening, the open channel and discharge opening. A closure lip is formed on the mounting end of the trough, the closure lip embracing the defined edge of the container opening and removably mounting the trough in a projected position with respect to the container. The material stored within the interior chamber of the container is in communication with the flow path formed by the trough such that the material may be directed into the trough through the container opening, moved through open trough, being visible along the open channel, and discharged through opening in the u-shaped wall of the trough.

Other features of the present invention will become apparent from the detailed description to follow, taken in conjunction with the accompanying drawings.

BRIEF DESCRIPTION OF THE DRAWINGS

For the purpose of illustrating the invention, there is shown in the drawings a form which is presently preferred; it being understood that the invention is not limited to the precise arrangements and instrumentalities shown.

DETAILED DESCRIPTION

Figure 1:
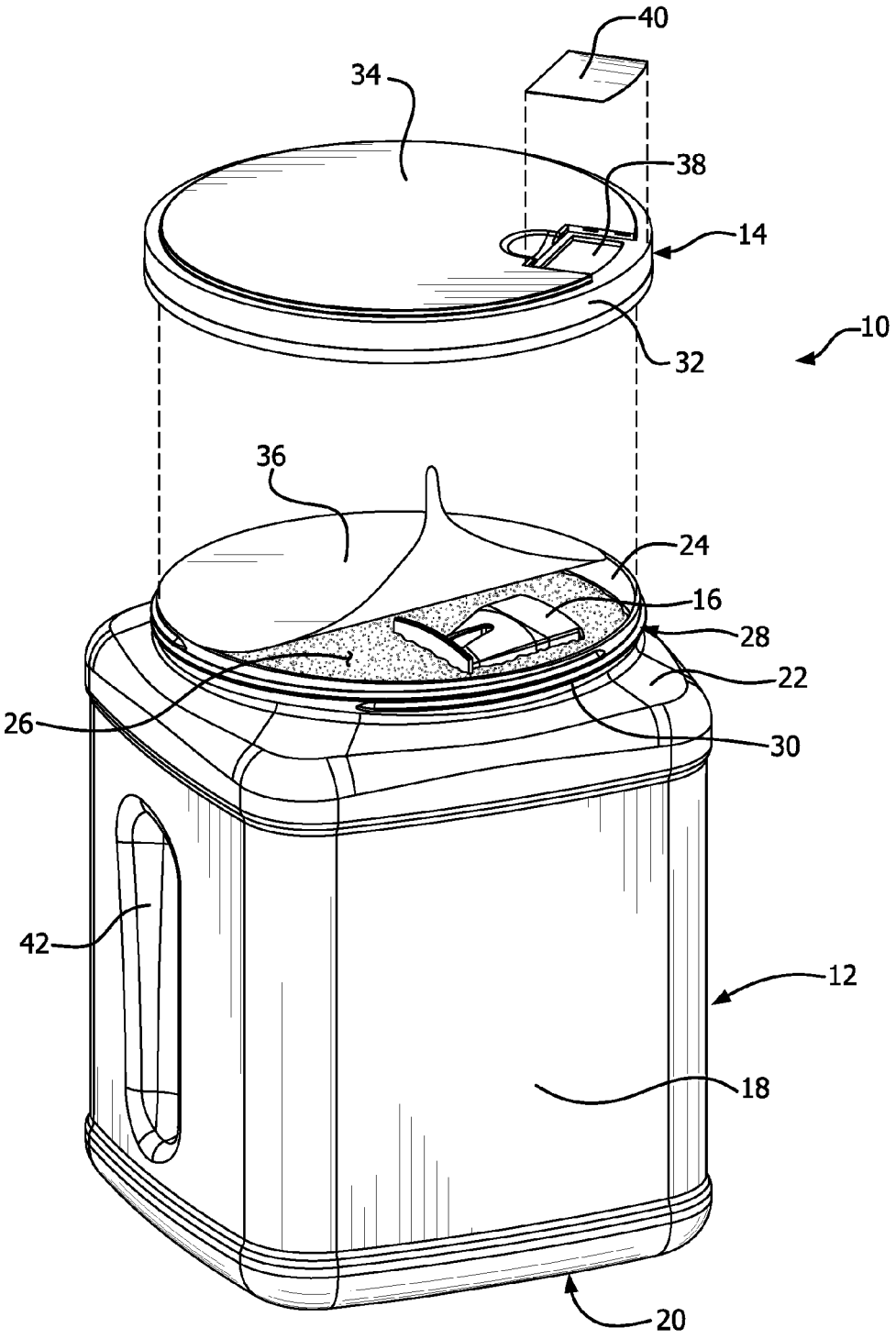
FIG. 1 is an exploded, isometric view of a container having a cap for closing a top opening in the container. A pouring spout is stored within the container prior to attachment to the container.

Referring now to the drawings, where like numerals identify like elements, there is shown in FIG. 1 a package that is generally referred to by the numeral 10. The package 10 generally comprises a container 12, a cap 14 and a pouring spout 16. The container 12 includes a plurality of side walls 18, a bottom wall 20 and a top wall 22 having an opening 24 therein. The walls 18, 20, 22 define a chamber for storing a quantity of pourable material 26 therein. The opening 24 in the top wall 22 includes an upwardly projecting rim 28 having an engagement thread 30 on the outside surface. A removable sealing membrane 36 is secured to the rim 28 of the container 12 for sealing the material contents 26 within the container 12 during shipment, etc. An exhaust valve may be provided on the membrane or container for degassing the material sealed within the package.

The cap 14 portion of the package is dimensioned to fit over the container opening 24 to close the storing chamber. The cap 14 is shown as having a depending flange 32, surrounding the body 34 of the cap 14. An inside surface of the flange 32 is contemplated to include a matching engagement thread (not shown) for engagement of the thread 30 on the container rim 28 to secure the cap 14 to the rim 28 and close the container 12. A spout opening 38 is provided in the body 34 of the cap 14 for receipt of the spout 16 after opening of the package 10. A removable cover 40 is provided for attachment to the cap body 34 prior to assembly of the spout 16 with the cap 14. An indentation 42 is shown in one of the side walls 18 of the container 12. Additional indentations may be provided at other positions on the side walls to assist in gripping the package. Alternate forms for the cap and container opening may be provided to removably (or otherwise) secure the cap to the opening. As a non-limiting example, the container may be round having a single continuous side wall. The container and cap may take other forms and shapes, without departing from the present disclosure.

Figure 2:
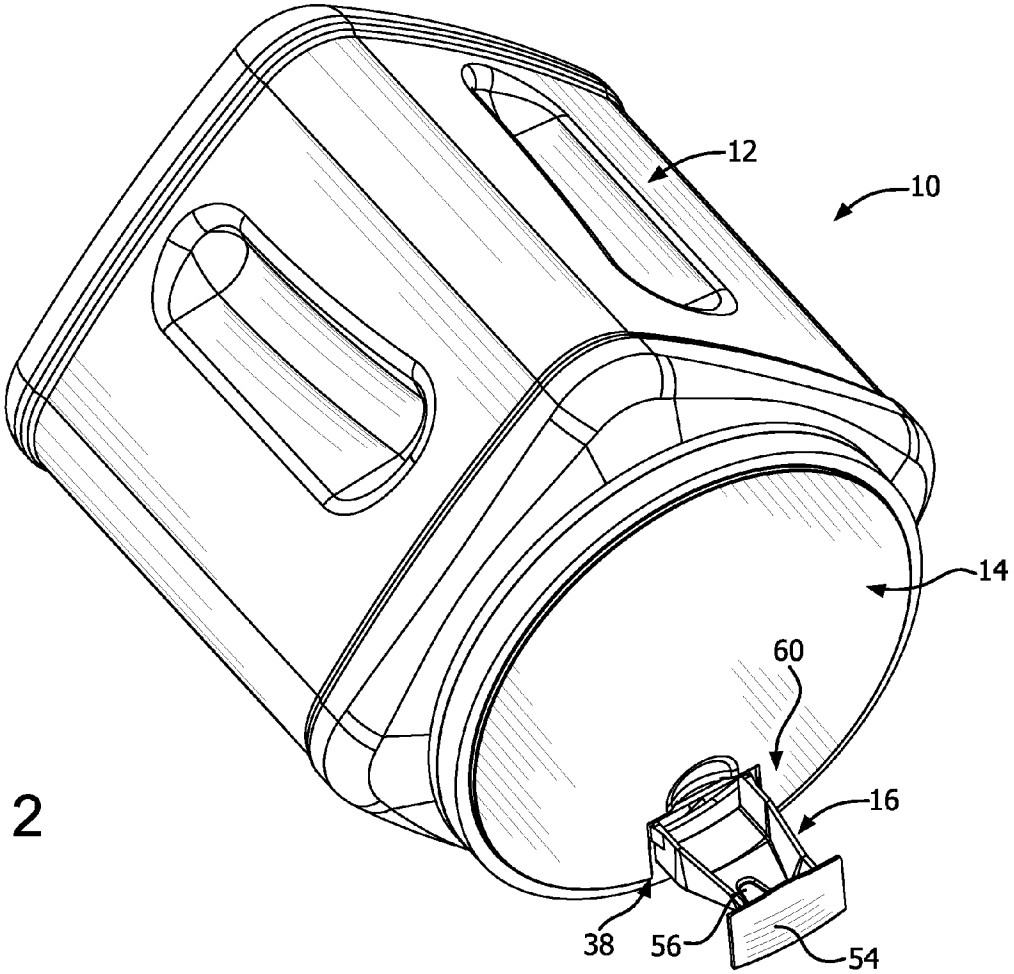
FIG. 2 is an isometric view of the container of FIG. 1 with the spout mounted in an opening in the cap and extended to a pouring position.

In FIG. 2, the package is shown in a pouring position. The sealing membrane (36) has been removed from the container rim (28), the spout 16 removed from the chamber and the cap engaged on the rim (28). The cover (40) is also removed from the spout opening 38 and the spout 16 is inserted into opening 38. The spout 16 is projected from the opening 38 and held in position by an engagement between the lip of the opening 38 and the mounting end of the spout 16. The structure or means for creating the engagement is discussed in more detail below. As shown, the package 10 is turned on its side, such that the material 26 moves towards the cap 14 and the spout opening 38 therein.

Figure 3:
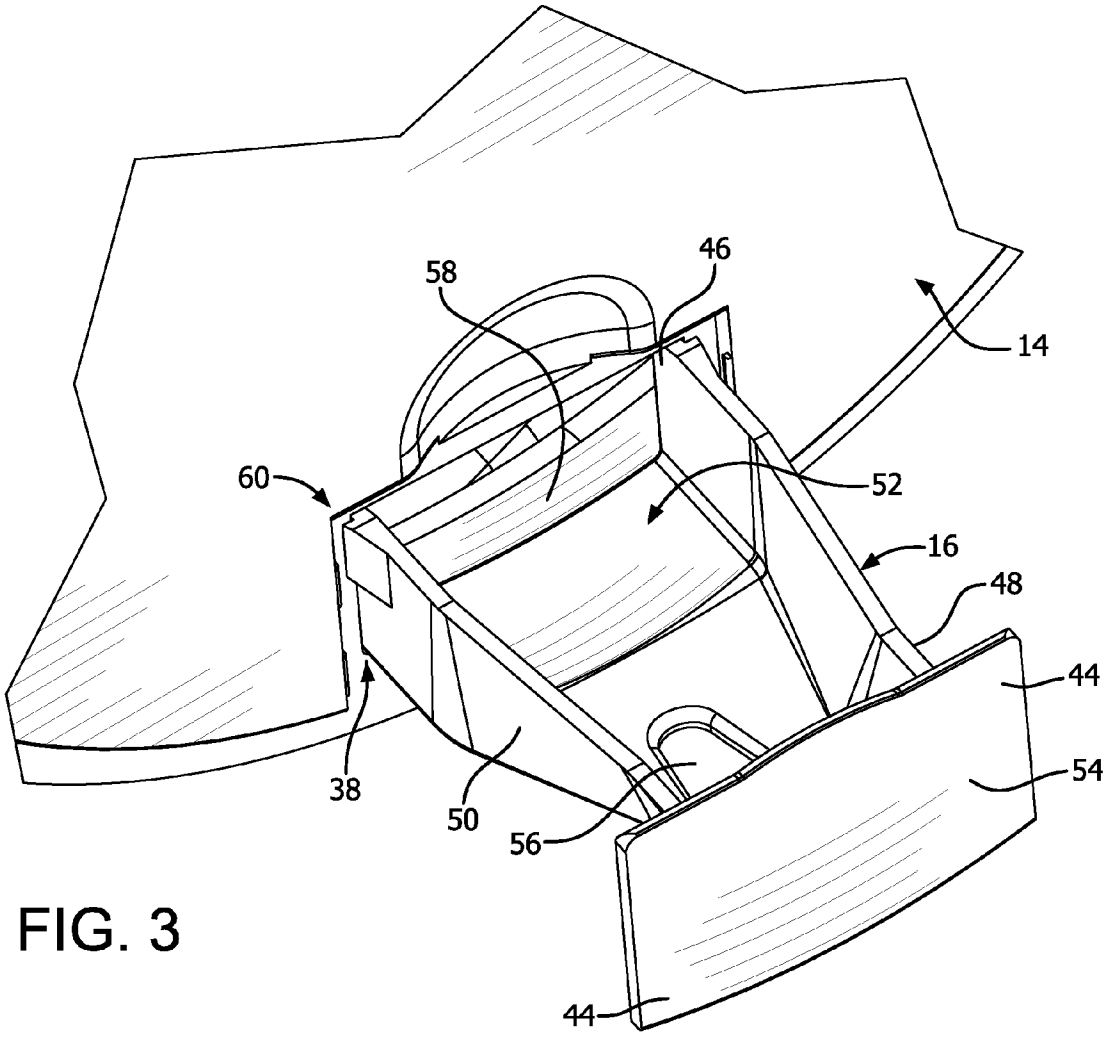
FIG. 3 is an enlarged, isometric view of the spout mounted in an opening in the cap positioned on the container, with the spout extended to the pouring position.

The structure of the spout 16 can be identified with greater precision in the enlarged view of FIG. 3. The spout 16 includes an open trough dimensioned for slidable engagement within the spout opening 38. The trough includes a mounting end 46, a discharge end 48, and a substantially u-shaped wall 50 extending between the mounting and discharge ends 46, 48. The u-shaped wall 50 forms a channel 52 that is open at the top. Preferably, the open top extends for the length of the wall 50. Alternatively, only a portion of the channel 52 is open, with at least the portion adjacent the discharge end being open. An end wall 54 is formed at the discharge end 48 of the spout 16. The end wall 54 extends across the u-shaped wall 50 and closes the discharge end of the channel 52. A discharge opening 56 is formed in the bottom surface of the u-shaped wall 50 adjacent the end wall 54 at the discharge end 48 of the spout 16.

The mounting end 46 of the spout 16 defines an inlet opening 58 for the trough formed by the u-shaped wall 50. The inlet opening 58 is shown as the open area at the rear of the trough. However, variations in the shape and form of the opening are possible. The purpose of the opening is to create a communication between the open channel 52 and the interior of the container 12. The result of the trough structure of the spout 16 is a flow path, formed between the inlet opening 58, the open channel 52 and the discharge opening 56, for visibly directing retained material from the container 12 to a desired receiving structure, positioned below the discharge opening 56.

Figure 4:
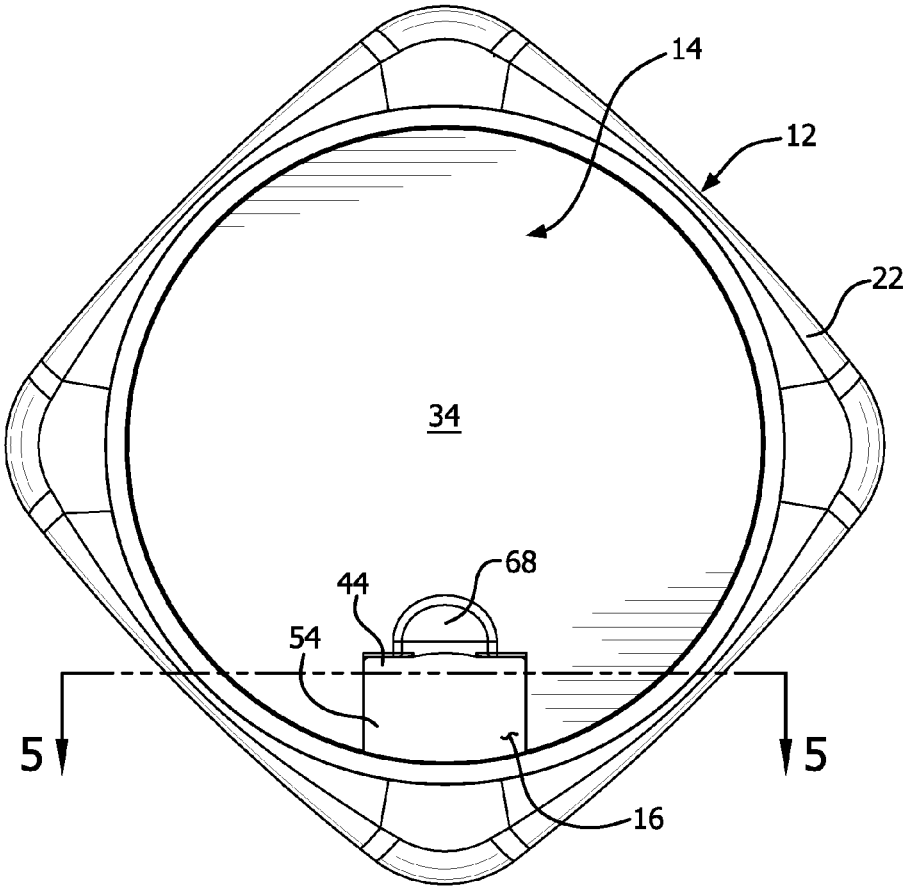
FIG. 4 is top plan view of the container with the spout retracted into the opening in the cap.
Figure 5A:
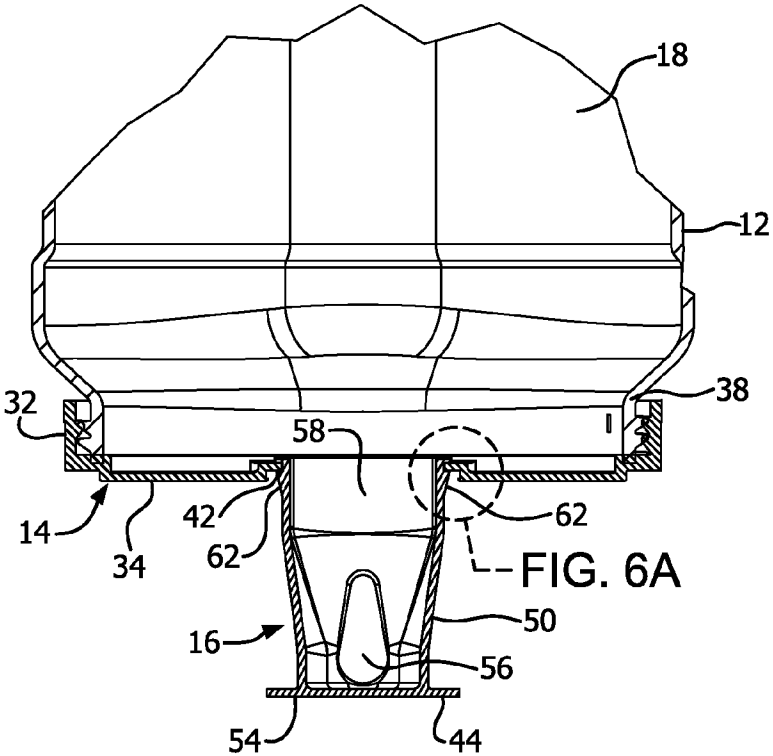
FIG. 5A is a partial cross sectional view of the container and spout, with the spout extended to the pouring position.
Figure 5:
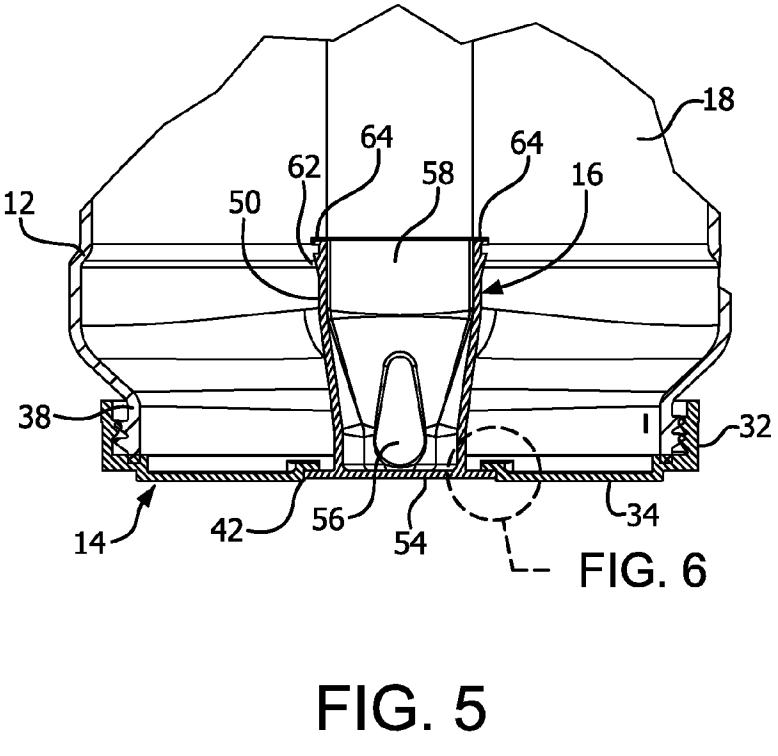
FIG. 5 is a partial cross sectional view of the container and spout as taken along line 5-5 in FIG. 4.

FIG. 4 shows an elevation view of the spout 16 mounted within the spout opening 38. In FIG. 5, the spout 16 is shown in a retracted position, with the end wall 54 positioned within the indentation 42 formed in the top surface of the body portion 34 of the cap 14. The cross section of FIG. 5A shows the spout 16 in the extended position, as also shown in FIG. 3.

The end wall 54 of the spout 16 is projected outwardly 44 (see from the discharge end of the trough formed by the u-shaped wall 50. Preferably, the trough tapers between the mounting end 46 and discharge end 48 of the spout 16. The tapered trough assists in directing the material towards the discharge opening 56. As shown in the cross section of FIG. 5, the outward projection 44 is dimensioned to fit within the indentation 42. The wall 54 preferably overlaps the lip of the spout opening 38, forming a closure for the opening. A series of engagement nubs 66 are positioned around the indentation 42. The outward projection 44 of the wall 54 is formed to fit under the nubs 66 which resiliently retain the spout 16 in the retracted position. The spout 16 can be removed, preferably easily, from the retracted position by insertion of a utensil, finger or the like in the access slot 68, with a substantially upward (transverse to the top surface of the body 34) force applied on the adjacent portion of the outward projection 44 of the end wall 54.

The mounting end 46 of the spout 16 includes means 60 for retaining the spout 16 in the spout opening 38 within the extended position. A portion of the structural elements of the retaining means 60 as shown in FIG. 3 as a gripping tab 62 formed on the outside surface of the u-shaped wall 50. As shown in FIG. 5A, a secondary tab is formed on the opposing side of the u-shaped wall 50. A backing tab 64 is formed adjacent the gripping tab 62 on each side of the mounting end 46 of the spout 16. A gap is formed between the gripping tab 62 and the backing tab 64. The mounting end 46 of the spout 16 is dimensioned to closely fit within the spout opening 38 within the body 34 of the cap 14. In the extended position of the spout 16, the tabs 62, 64 engage the lip of the spout opening 38. The tabs 62 engage the peripheral edge of the spout opening 38. The projected mounting of the spout 16 is shown in cross section in FIG. 5A.

Figure 6:
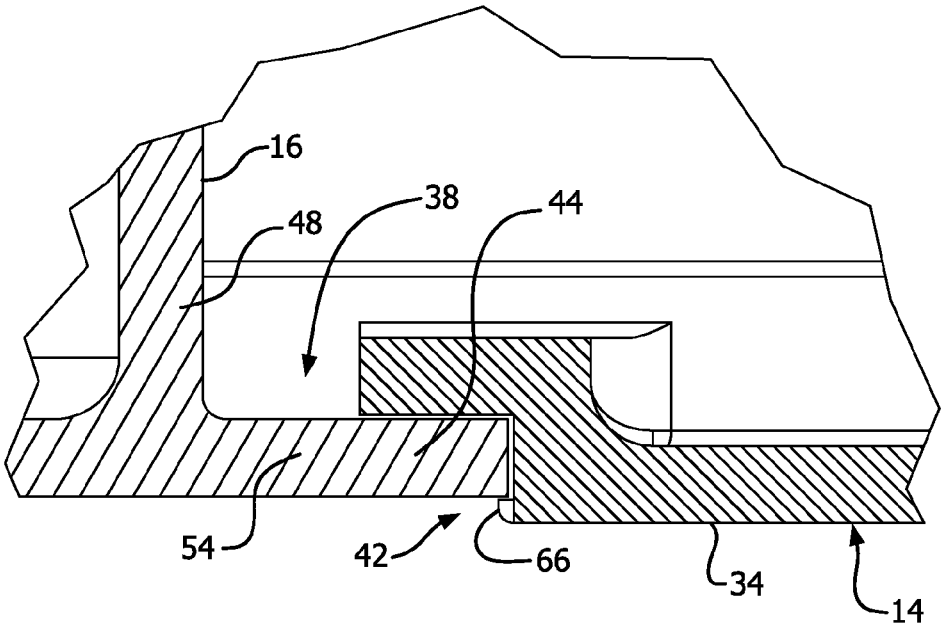
FIG. 6 is an enlarged, partial cross section taken from FIG. 5 showing the engagement of a closure end of the spout within the cap opening.
Figure 6A:
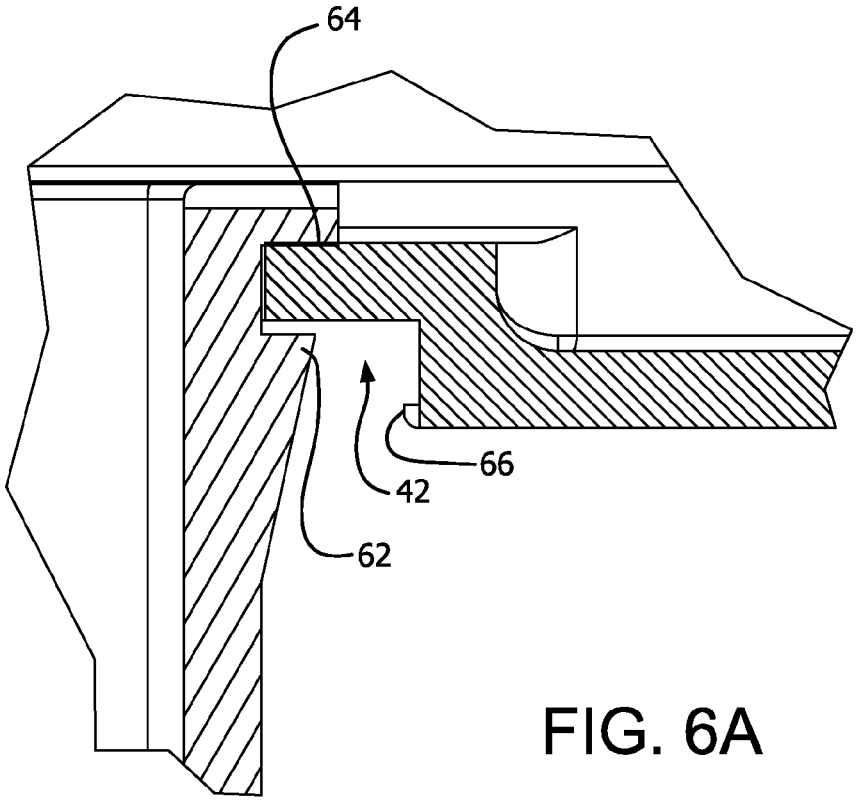
FIG. 6A is an enlarged, partial cross section taken from FIG. 5A showing the engagement of end of the spout with the cap opening.

The engagement is shown in more detail in the enlarged cross section of FIG. 6A. The combination of the dimensional relationship between the mounting end 46 and the lip of the spout opening 38 and the engagement of the tabs 62, 64 frictionally retain the spout 16 on the cap 14 in the extended position. In the extended position, the spout 16 creates the flow path between the container and the discharge opening 58 of the spout 16. The flexible nature of the u-shaped wall 50 permits the spout 16 to be moved from the extended position (FIGS. 3, 5A and 6A) back to the closed position (FIGS. 4, 5 and 6).

Figure 7:
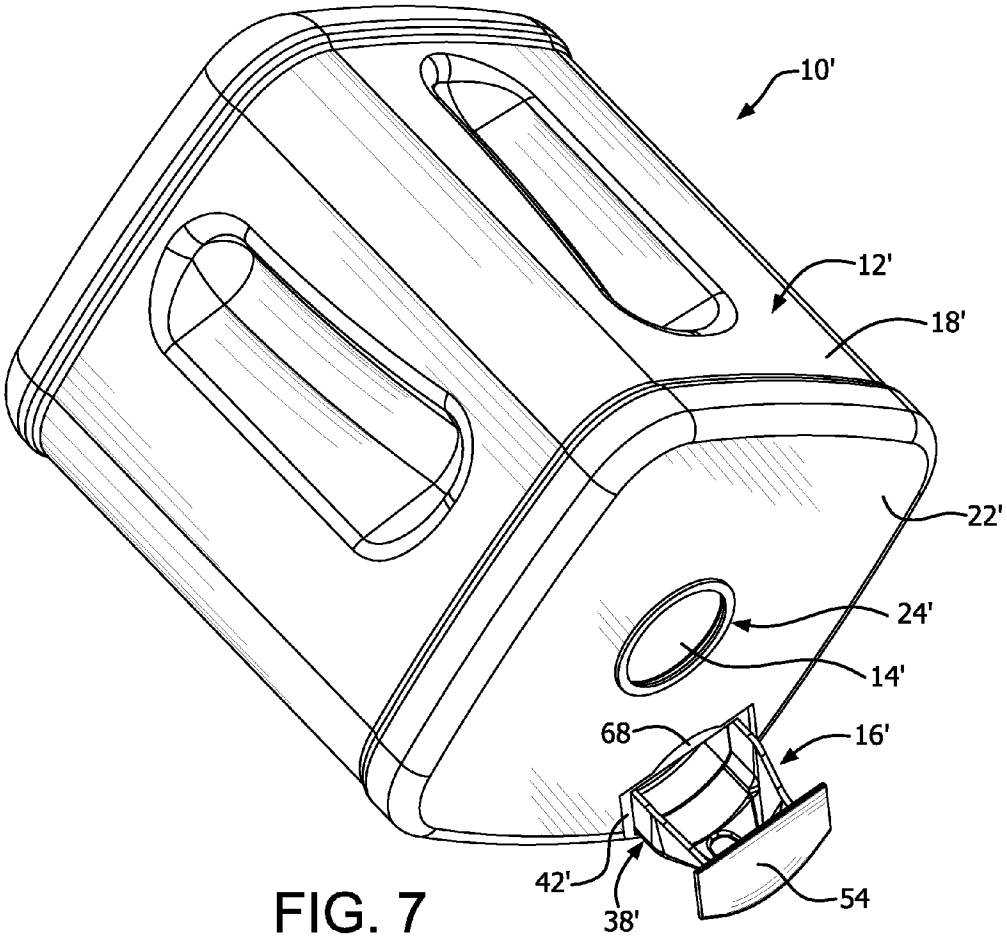
FIG. 7 is an isometric view of further embodiment of a container having a pouring spout mounted in an opening in the container and extended to a pouring position.
Figure 8:
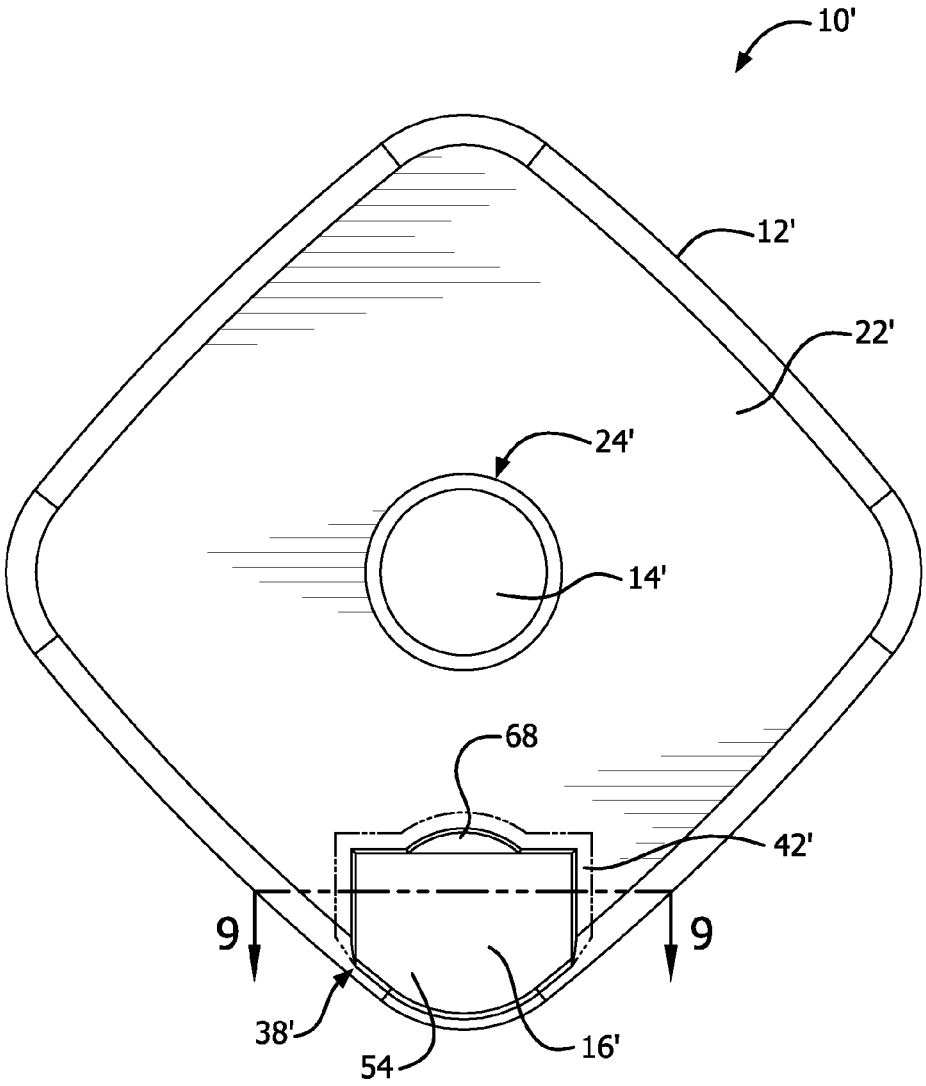
FIG. 8 is top plan view of the container of FIG. 7 with the spout retracted into the opening in the container.
Figure 9A:
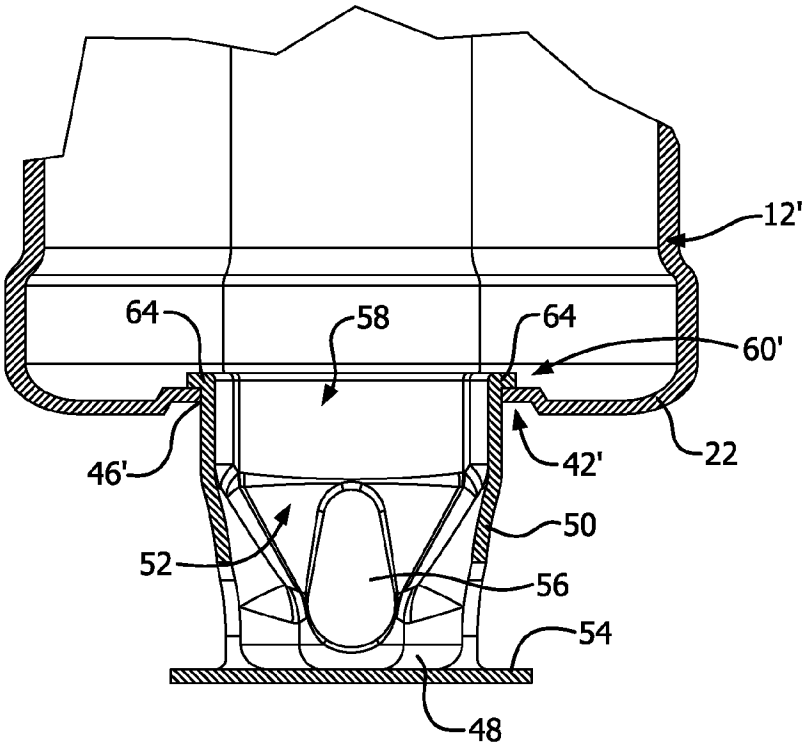
FIG. 9A is a partial cross sectional view of the container and spout of FIGS. 7-9, with the spout extended to the pouring position.
Figure 9:
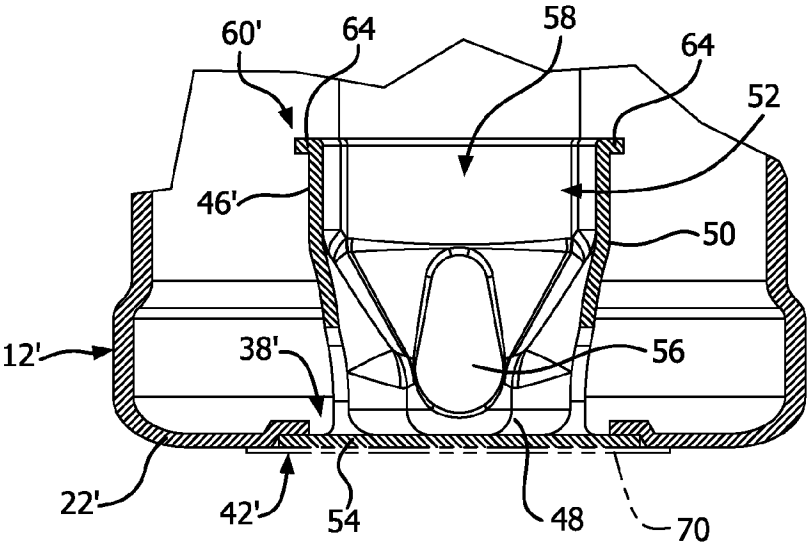
FIG. 9 is a partial cross sectional view of the container and spout as taken along line 9-9 in FIG. 8.

In FIGS. 7-10A there is shown a further form of a package 10' having a container 12' formed with an integral or fixed top wall 22', a filling opening 24'. A cap 14' closes the filling opening 24' in the top wall 22' to seal the contents of the container 12'. A spout opening 38' is provided in the top wall 22', adjacent the connection of the top wall 22' with a side wall 18'. A spout 16' is movably mounted within the spout opening 38. As shown in FIG. 7, the spout 16' is projected from top wall 22', in an extended or pouring position. In the elevation view of the top wall 22' in FIG. 8, the spout 16' is retained within a recess or indentation 42' formed in the top wall 22'. FIG. 9 shows the spout 16' and top wall 22' in cross section, with the spout in the recessed position.

In the cross sections of FIGS. 9 and 9A, the two positions of the spout 16' are shown. In the recessed position, the end wall 54 of the spout formation is retained within the indentation 42' in the top wall 22' of the container 12'. A sealing label 70 is shown in phantom, positioned over the end wall 54 and overlapping the portion of the top wall 22' adjacent the indentation 42'. The sealing label 70 may be used during shipping of the package 10', prior to use of the package by the consumer. The label 70 is removed to provide access to the spout 16'. As shown in FIGS. 7 and 8, an access slot 68 is provided adjacent the end wall 54 of the spout 16' for lifting the spout 16' from the indentation 42 in the top wall 22' to move the spout 16' to the extended or pouring position (FIGS. 7 and 9A).

The spout 16' in the present embodiment is generally formed the same as that shown in FIGS. 1-6A. The end wall 54 is positioned at the discharge end 48 of the trough formed by the u-shaped wall 50. The end wall 54 closes the trough and is located adjacent the discharge opening 56 formed in the bottom surface of the u-shaped wall 50. The trough is tapered from the mounting end 46' to the discharge end 48. The u-shaped wall 50 is open at the mounting end 46', forming an inlet opening 56 for the trough. A flow path is formed from the inlet 56, along the u-shaped wall, to the discharge opening 56. The flow path is visible through the open channel 52 of the u-shaped wall 50. The end wall 54 directs the material flow within the channel 52 towards the discharge opening 56.

The retaining means 60' on the mounting end 46' of the spout 16' includes a backing tab (or tabs) 64 projected from the periphery of the u-shaped wall 50. As shown in FIG. 9A, when the spout 16' is in the pouring position, the backing tab(s) 64 abut the inside surface of the top wall 22', adjacent the indentation 42'. A friction fit between the u-shaped wall 50 of the spout 16' is contemplated to retain the spout 16' in the pouring position. Alternative or supplemental engagement structures may also be provided, such as the gripping tabs (62) discussed in the prior embodiment.

Figure 10:
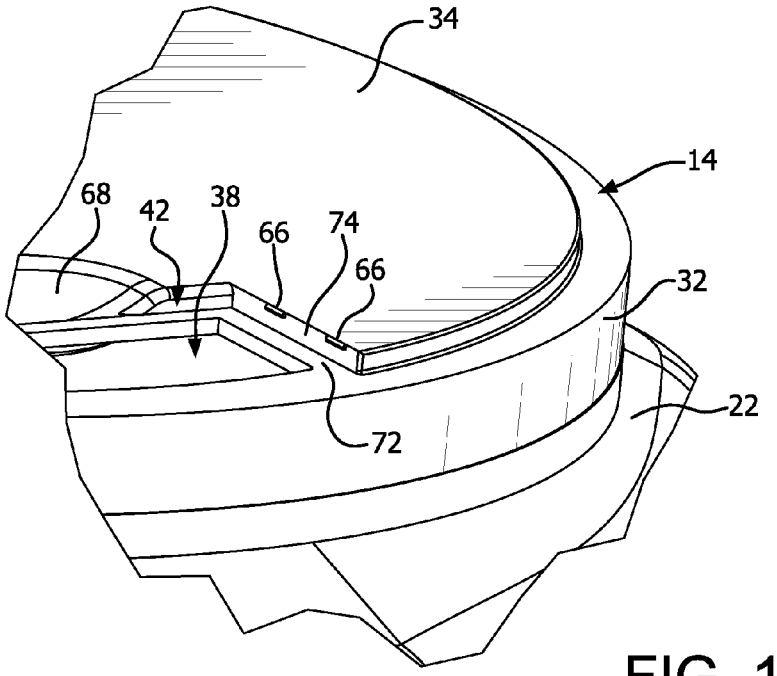
FIG. 10 is a partial perspective view of the opening in the container of FIGS. 7-9A, with the spout removed.
Figure 10A:
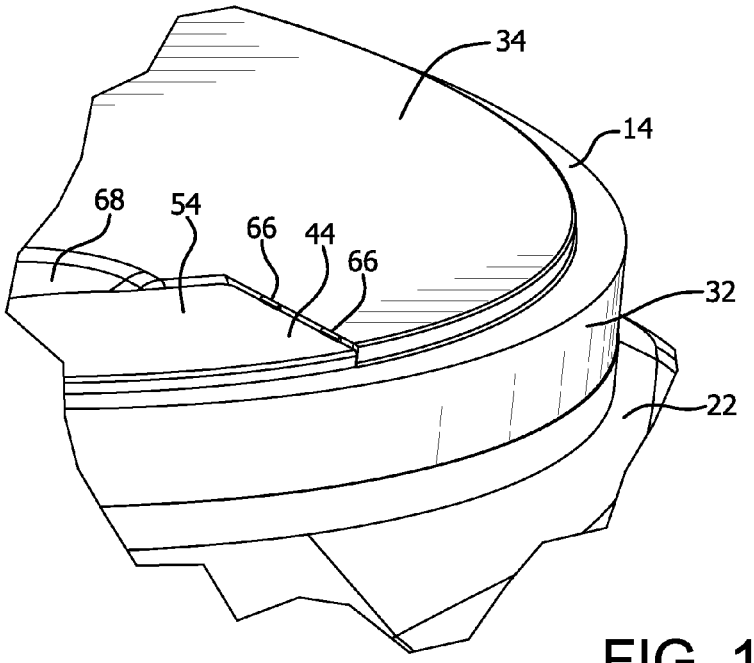
FIG. 10A is a partial perspective view of the container of FIGS. 7-10, with the spout retracted into the container opening.

The indentation 42 within the cap 14 of the package 10 is shown in greater detail in the enlarged view of FIG. 10. The indentation 42' in the top wall 22' of the container 12' of the further embodiment discussed may be similarly formed. The spout opening 38 is defined in the body 34 of the cap 12. An outer rim 72 surrounds the opening 38. The outer rim 72 is surrounded by the indentation wall 74. The indentation wall 74 defines the indentation 42 in the cap body 34. A pair of retention nubs 66 is provided on the indentation wall 74 and project a short distance inwardly. An opposing set of nubs are contemplated to be located on the opposite side of the indentation. The access slot 68 is formed in the body 34 of the cap 14, adjacent the indentation 42. In FIG. 10A, the spout 16 is positioned within the spout opening 38 and is moved to the retracted or sealing position. The end wall 54 of the spout 16 is retained within the indentation, with the outward projection 44 of the wall 54 positioned adjacent the indentation wall 74. The nubs 66 engaged the outward projection 44 and frictionally retain the end wall 54 within the indentation 42. As shown in the cross section of FIG. 6, for example, the outward projection 44 of the end wall 54 overlaps the outer rim 72 adjacent the spout opening 38.

The open channel 52 provided in the spout embodiments 16, 16' provide visual access to the flow of material as it moves from the container 12, 12' to the discharge opening 56. The tapering of the u-shaped wall 50 and the positioning of the end wall 54, across the channel 52 both assist in the control of the pour from the spout 16, 16'.

The spout may be separately provided from the container or cap and mounted in an opening by the user prior to pouring. The spout is contemplated to be made from a flexible material, such that the walls at the mounting end can be resiliently flexed inwardly to position the end in the opening. The engagement means on the mounting end of the spout serves to temporarily fix the spout in the extended or pouring position. Alternative means formed on the spout opening may also be provided to assist in the retention of the spout during pouring. In the retracted or sealing position, it is preferred that some retaining structure be provided to secure the spout in the opening and to seal the opening. These functions are served in the embodiments shown by the end wall of the spout and the engagement of the end wall within the indentation in the cap and container top wall.

In the embodiments shown, the spout is positioned in the top wall or top cap for the package. This arrangement serves to prevent accidental discharge of the material retained within the container. Other positions are contemplated, such as mounting the spout on the side wall of the container. The form of the container and cap are not limited to the specific structures shown. The preferred material for forming the spout is a resilient or semi-flexible thermoplastic. However, spout, container and cap may be made of any number of materials.

The present disclosure shows and describes one or more exemplary embodiments. It should be understood by those skilled in the art from the foregoing that various other changes, omissions and additions may be made therein, without departing from the spirit and scope of the contemplated invention, with the scope of the invention being defined by the foregoing claims. Further, the terms herein are used in a generic and descriptive sense and are not necessarily for purposes of limitation. The scope of the invention is set forth in the following claims.

What is claimed is:

1. A pouring spout mountable within an opening in a container, the pouring spout comprising:

a trough dimensioned for slidable engagement within a spout opening within a container, the trough having a mounting end, a discharge end, and a substantially u-shaped wall extending between the mounting and discharge ends, the u-shaped wall forming an open channel extending along at least a portion of the trough adjacent the discharge end, an end wall formed at the discharge end of the trough, the end wall extending across and closing the open channel formed by the u-shaped wall, a discharge opening formed in the u-shaped wall adjacent the end wall at the discharge end, an inlet opening within the mounting end of the trough, the inlet opening communicating with the open channel formed by the u-shaped wall, wherein a flow path is formed between the inlet opening, the open channel and discharge opening, the flow path being visible within the open channel of the u-shaped wall, and a retainer is formed on the mounting end of the trough, the retainer engaging the spout opening and removably mounting the spout in a projected position with respect to the container, and the contents of the container in communication with the flow path formed by the trough.

2. A pouring spout as in claim 1 wherein the trough is tapered in the direction of the discharge end.

3. A pouring spout as in claim 1 wherein the retainer comprises one or more backing tabs formed on the mounting end of the spout, the one or more backing tabs formed for engagement with the spout opening within a container.

4. A pouring spout as in claim 3 further comprising one or more gripping tabs formed on the u-shaped wall of the spout in a spaced relationship with the one or more backing tabs.

5. A pouring spout as in claim 1 wherein the mounting end is dimensionally formed to create friction fit between the spout and the spout opening in a container.

6. A container and pouring spout combination comprising:

a container for retaining a quantity of pourable material within a interior chamber, the chamber defined by one or more side walls, a bottom wall and top wall, a container opening formed in one of the walls, the opening having a defined edge, the opening providing access to material stored within the interior chamber; and a pouring spout comprising a trough dimensioned for slidable engagement within the container opening, the trough having a mounting end, a discharge end, and a substantially u-shaped wall extending between the mounting and discharge ends, the u-shaped wall forming a channel having an open upper area extending along at least a portion of the trough adjacent the discharge end, an end wall formed at the discharge end of the trough, the end wall extending across and closing the channel formed by the u-shaped wall, a discharge opening formed in the u-shaped wall adjacent the end wall at the discharge end, an inlet opening within the mounting end of the trough, the inlet opening communicating with the open channel formed by the u-shaped wall, wherein a flow path is formed between the inlet opening, the open channel and discharge opening, and a retainer is formed on the mounting end of the spout, the retainer embracing the defined edge of the container opening for movably mounting the spout in a projected position with respect to the container, wherein the material stored within the interior chamber of the container is in communication with the flow path formed by the trough such that the material may be directed from the container opening, through the inlet of the trough, visually along the open channel to the discharge end, and through the discharge opening in the wall of the trough.

7. A container and pouring spout combination as in claim 6 wherein the trough is tapered in the direction of the discharge end.

8. A container and pouring spout combination as in claim 6 wherein the retainer comprises one or more backing tabs formed on the mounting end of the spout, the one or more backing tabs formed for engagement with the container opening.

9. A container and pouring spout combination as in claim 8 further comprising one or more gripping tabs formed on the wall of the spout in a spaced relationship with the one or more backing tabs.

10. A container and pouring spout combination as in claim 6 wherein the mounting end is dimensionally formed to create friction fit between the spout and the container opening.

11. A container and pouring spout combination as in claim 6 wherein an indentation is formed adjacent the container opening, the indentation formed for receipt of the end wall of the spout.

12. A container and pouring spout combination as in claim 11 wherein the end wall of the spout is frictionally retained within the indentation in a retracted position for the spout.

13. A container and pouring spout combination as in claim 6 wherein the top wall of the container comprises an opening defined by a projected rim and a cap is provided for removably covering the opening and engaging the projected rim.

14. A container and pouring spout combination as in claim 13 wherein the container opening for mounting the spout is formed in the cap.

15. A container and pouring spout combination as in claim 6 wherein the top wall of the container comprises an opening for filling the container and a cap removably covering the opening.

16. A container and pouring spout combination as in claim 15 wherein the container opening for mounting the spout is formed in the top wall, separate from the filling opening.

* * * * *